US006161795A

United States Patent [19]

Skerrett et al.

[11] Patent Number: 6,161,795

[45] Date of Patent: Dec. 19, 2000

[54] SURFACE UNWIND JUMBO ROLL TISSUE DISPENSER

[75] Inventors: John Richard Skerrett, Alpharetta; Richard Paul Lewis, Marietta; Stephen Lawrence Phelps, Lilburn; Paul Francis Tramontina, Alpharetta, all of Ga.

[73] Assignee: Kimberly-Clark Worldwide, Inc., Neenah, Wis.

[21] Appl. No.: 09/385,928

[22] Filed: Aug. 30, 1999

Related U.S. Application Data

[60] Provisional application No. 60/112,508, Dec. 14, 1998.

[51] Int. Cl.[7] ..... B65H 16/10

[52] U.S. Cl. ..... 242/564.5; 242/580.1; 242/595.1

[58] Field of Search ..... 242/564.5, 566, 242/580.1, 595, 595.1, 423.2

[56] References Cited

U.S. PATENT DOCUMENTS

| | | | |
|---|---|---|---|
| 2,334,689 | 11/1943 | Wooster | 242/595.1 |
| 2,730,310 | 1/1956 | Schultz | 242/595.1 X |
| 2,873,158 | 2/1959 | Pinkham, Jr. | 242/595.1 X |
| 3,167,368 | 1/1965 | Rozlog et al. | 312/39 |
| 3,861,610 | 1/1975 | Landis et al. | 242/564.4 X |
| 3,912,187 | 10/1975 | Woelky . | |
| 4,070,047 | 1/1978 | Lindelöw . | |
| 4,141,516 | 2/1979 | Olson . | |
| 4,148,442 | 4/1979 | Baumann et al. . | |
| 4,192,442 | 3/1980 | Bastian et al. | 226/127 |
| 4,203,562 | 5/1980 | DeLuca et al. . | |
| 4,206,858 | 6/1980 | DeLuca et al. | 225/96 |
| 4,236,679 | 12/1980 | Jespersen . | |
| 4,260,117 | 4/1981 | Perrin et al. . | |
| 4,291,845 | 9/1981 | Van Cleave . | |
| 4,307,638 | 12/1981 | DeLuca et al. | 83/37 |
| 4,307,639 | 12/1981 | DeLuca | 83/337 |
| 4,317,547 | 3/1982 | Graham, Jr. et al. . | |
| 4,340,195 | 7/1982 | DeLuca . | |
| 4,358,169 | 11/1982 | Filipowicz et al. | 312/39 |
| 4,378,912 | 4/1983 | Perrin et al. . | |
| 4,383,657 | 5/1983 | Suh . | |
| 4,396,163 | 8/1983 | Graham, Jr. et al. . | |
| 4,403,748 | 9/1983 | Cornell . | |
| 4,487,375 | 12/1984 | Rasmussen et al. . | |
| 4,497,453 | 2/1985 | Butcher . | |
| 4,522,346 | 6/1985 | Jespersen . | |
| 4,580,738 | 4/1986 | Scheer . | |
| 4,611,768 | 9/1986 | Voss et al. . | |
| 4,634,192 | 1/1987 | Fielding | 312/37 |
| 4,649,693 | 3/1987 | Yeager | 53/219 |
| 4,651,938 | 3/1987 | Memminger et al. . | |
| 4,664,304 | 5/1987 | Wendt et al. | 226/127 |
| 4,807,824 | 2/1989 | Gains et al. . | |
| 4,846,412 | 7/1989 | Morand . | |
| 4,856,724 | 8/1989 | Jespersen . | |
| 4,936,079 | 6/1990 | Skalsky et al. | 53/219 |

(List continued on next page.)

FOREIGN PATENT DOCUMENTS

| | | |
|---|---|---|
| 2752715 | 3/1998 | France . |
| 96/20631 | 7/1996 | WIPO . |

OTHER PUBLICATIONS

Abstract, FR 2752715, Hetru, M.J. Mar. 6, 1998.
Copy of PCT International Search Report of Mar. 17, 2000.

*Primary Examiner*—Donald P. Walsh
*Assistant Examiner*—William A. Rivera
*Attorney, Agent, or Firm*—Nancy M. Klembus

[57] ABSTRACT

A dispenser for dispensing a jumbo roll of material having an axis of rotation, the dispenser including a housing adapted to receive a jumbo roll of material. A first drive assembly is provided, the first drive assembly including a first belt. A second drive assembly is also provided, the second drive assembly including a second belt. The first drive assembly and the second drive assembly are positioned with respect to each other so that a surface of the first belt is proximate to a surface of the second belt, thereby forming a channel through which the material from the jumbo roll must pass to be dispensed from the dispenser. The channel additionally assists in retaining the material in a dispensing position.

21 Claims, 5 Drawing Sheets

U.S. PATENT DOCUMENTS

| | | | |
|---|---|---|---|
| 4,944,466 | 7/1990 | Jespersen . | |
| 5,060,877 | 10/1991 | Bullivant . | |
| 5,244,161 | 9/1993 | Wirtz-Odenthal . | |
| 5,294,192 | 3/1994 | Omdoll et al. | 312/34.22 |
| 5,333,803 | 8/1994 | Planeta | 242/555.3 |
| 5,375,785 | 12/1994 | Boone et al. | 242/560.1 |
| 5,400,982 | 3/1995 | Collins | 242/560 |
| 5,526,973 | 6/1996 | Boone et al. | 225/34 |
| 5,558,302 | 9/1996 | Jesperson | 242/560 |
| 5,601,253 | 2/1997 | Formon et al. | 242/595.1 |
| 5,697,576 | 12/1997 | Bloch et al. | 242/596.8 |

SURFACE UNWIND JUMBO ROLL TISSUE DISPENSER

This application claims priority from U.S. Provisional Application No. 60/112,508 filed on Dec. 14, 1998.

FIELD OF THE INVENTION

The present invention relates generally to tissue dispensing mechanisms, and more particularly to a tissue dispensing mechanisms for jumbo rolls.

BACKGROUND OF THE INVENTION

It is a benefit to institutional and public facilities to reduce the maintenance required to ensure that a sufficient supply of rolled materials such as, for example, paper towels and toilet tissue is provided within that facility's rest room. Many manufacturers of tissue produce "jumbo" rolls which hold significantly more tissue than traditional rolls. These jumbo rolls are typically eight to thirteen inches in diameter while traditional rolls are typically four to five inches in diameter. While traditional rolls are frequently mounted to a wall so that their axis of rotation is parallel to the wall, the large diameter of jumbo rolls may require that such rolls are mounted to the wall with their axis of rotation is perpendicular to the wall. Dispensers for these jumbo rolls are likewise significantly larger than dispensers for traditional rolls, and may be configured so that the tissue is dispensed from a lower opening in the dispenser. One of the lower edges of the dispenser may be sharp or serrated, thus enabling a user to pull the tissue against this edge and tear a selected amount of tissue from the roll.

A disadvantage of these jumbo dispensers is that it may be difficult for a user to withdraw tissue from the roll, especially if a new jumbo roll is being dispensed as full and nearly-full jumbo rolls may be heavy and require that a significant pulling force be applied to the end of the rolled material. In some instances, the pulling force applied to the end of the rolled material does not force the jumbo roll to rotate, but rather merely tears off an insufficient amount of the rolled material.

On occasion, the end of the rolled material does not extend out of the dispenser or may not be visible to a user. In some instances, this may occur because the force applied to the end of the rolled material causes it to tear within or snap back into the dispenser. The user then must extend a hand up into the dispenser to locate the end of the rolled material. When doing so, the user may be scratched on the sharp or serrated edge of the dispenser. Additionally, some users may not be able to reach far enough into the dispenser to grasp the torn end of the rolled material.

It may also be desirable for a dispenser to be able to dispense a partially-used roll, sometimes referred to as a "stub" roll, at the same time that a new jumbo roll is being dispensed. This enables a partially-dispensed or "stub" roll to be utilized fully while permitting maintenance personnel to change rolls on a regular maintenance schedule rather than requiring that they return precisely when the roll has been fully dispensed. The ability to utilize partially dispensed rolls is important as it enables a partially dispensed roll to be replaced with a full roll of material without wasting the "stub" roll. Thus, it is not necessary to wait until the roll of material is fully used before a new, full roll of material may be placed within the dispenser. This reduces or eliminates extra trips to the facility by maintenance personnel to determine if a roll has been fully used and may be replaced.

Thus, a dispenser is needed which dispenses a jumbo roll of material and assists in retaining the end of the rolled material in a position so that it may be easily grasped by a user. Additionally, a dispenser is needed which enables a stub roll and a full roll to be dispensed at the same time, thus reducing and simplifying the maintenance required by the dispenser.

SUMMARY OF THE INVENTION

In response to the foregoing problems and difficulties encountered by those of skill in the art, the present invention is directed toward a dispenser for dispensing a jumbo roll of material having an axis of rotation.

In particular embodiments, the dispenser includes a housing adapted to receive a jumbo roll of material. A first drive assembly including a first belt is provided, and a second drive assembly including a second belt is also provided. The first drive assembly and the second drive assembly are positioned below and support the jumbo roll. The first drive assembly and the second drive assembly may be positioned with respect to each other so that a surface of the first belt is proximate to a surface of the second belt, thereby forming a channel through which the material to be dispensed may pass. Additionally, the channel may assist in retaining the material in a dispensing position.

The first drive assembly is mounted within the housing of the dispenser and may include a first drive roller which may be rotatably mounted to the housing. In some embodiments, the axis of rotation of the first drive roller may be parallel to the axis of rotation of the jumbo roll of material. A first feed roller may be further included in the first drive assembly, the first feed roller having an axis of rotation which may be parallel to the axis of rotation of the first drive roller. The first feed roller may also be rotatably mounted to the housing. A first belt may also be included in the first drive assembly, the first belt contacting the first drive roller and the first feed roller so that, as the first drive roller and the first feed roller rotate about their respective axes of rotation, the first belt rotates in the same direction.

Selected embodiments of the dispenser may include a second drive assembly which may be mounted within the housing. The second drive assembly may include a second drive roller which may be rotatably mounted to the housing. The axis of rotation of the second drive roller is parallel to the axis of rotation of the jumbo roll of material. The second drive roller may, in certain embodiments, include a belt portion and a roller support portion. Each portion of the second drive roller may be rotatable about the axis of rotation of the second drive roller, and each portion may rotate about that axis of rotation independently of the other portions. For example, the belt portion of the second drive roller may be rotating in a counterclockwise direction while the support portion of the second drive roller is rotating in a clockwise direction.

A second feed roller may also be included in the second drive assembly, the second feed roller having an axis of rotation which may be parallel to the axis of rotation of the second drive roller. The second feed roller may also be rotatably mounted to the housing. A second belt may contact the second feed roller and the belt portion of the second drive roller so that, as the belt portion of the second drive roller and the second feed roller rotate about their respective axes of rotation, the second belt rotates in the same direction.

In some embodiments, the first drive assembly and second drive assembly are positioned with respect to each other so that a surface of the first belt is proximate to a surface of the second belt. An auxiliary roller may be provided in particular embodiments to urge the first belt toward the second belt.

In this manner, a narrow channel may be formed. In some embodiments, the belts may contact each other at least one location to form a nip.

The first and second drive assemblies may be positioned within the housing so that a jumbo roll of material may be supported by the first drive roller and the support portion of the second drive roller. The free end of the jumbo roll of material may be positioned within the channel that is formed between the surfaces of the first belt and the second belt so that, as the first belt and the second belt rotate, material is dispensed from the jumbo roll. The material of the roll may be held by the nip to assist Selected embodiments of the dispenser may include stub support rollers rotatably mounted to the housing. The stub rollers are adapted to support a "stub roll" or a roll of material which has been partially dispensed. The free end of the stub roll may be aligned with the free end of the roll of material so that material from both rolls may be dispensed at the same time.

Other objects, advantages and applications of the present invention will be made clear by the following detailed description of a preferred embodiment of the invention and the accompanying drawings wherein reference numerals refer to like or equivalent structures.

DETAILED DESCRIPTION

Figure 1:
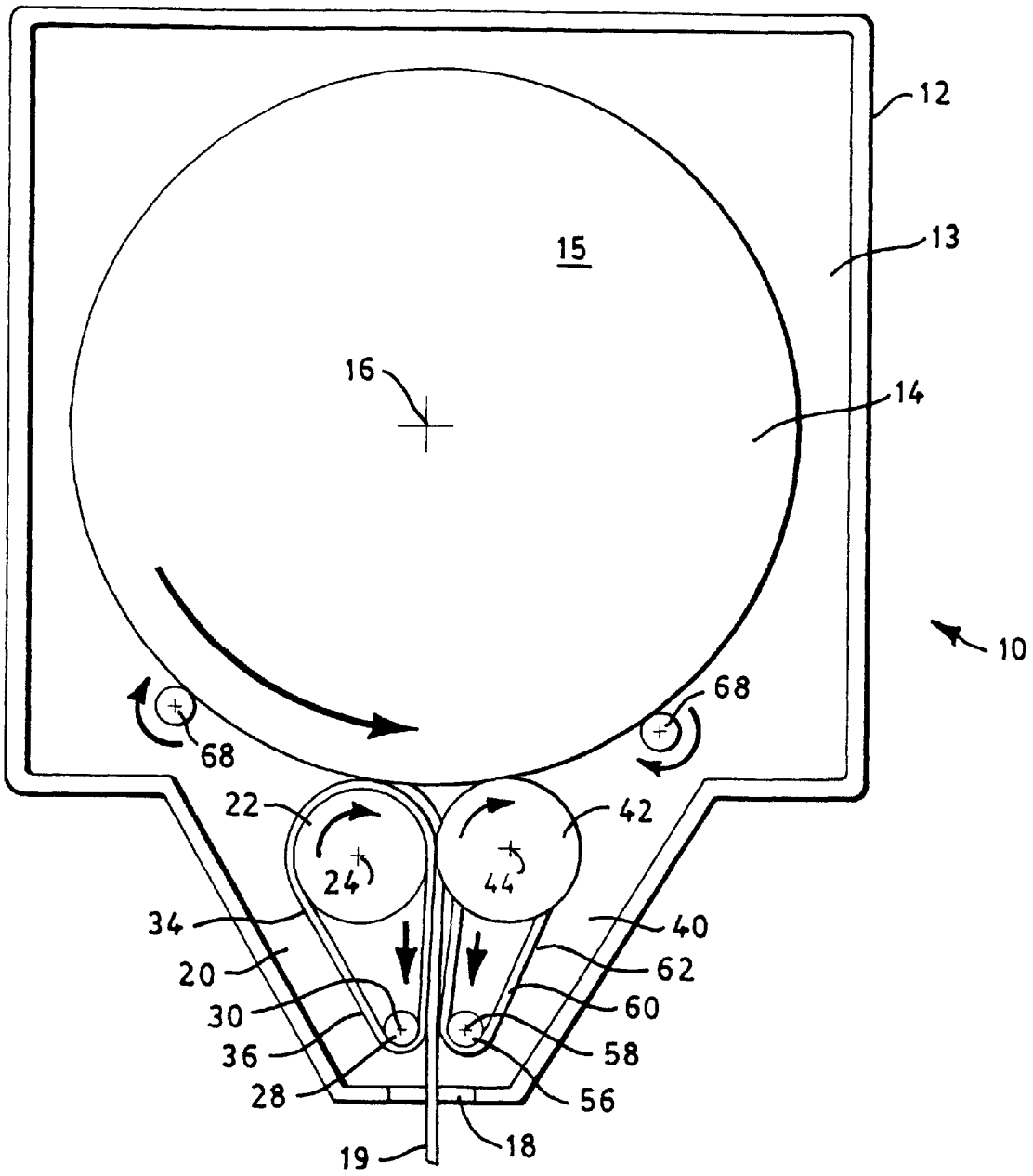
FIG. 1 is a front view of an embodiment of the dispenser according to the present invention, the dispenser having a transparent front panel.
Figure 4:
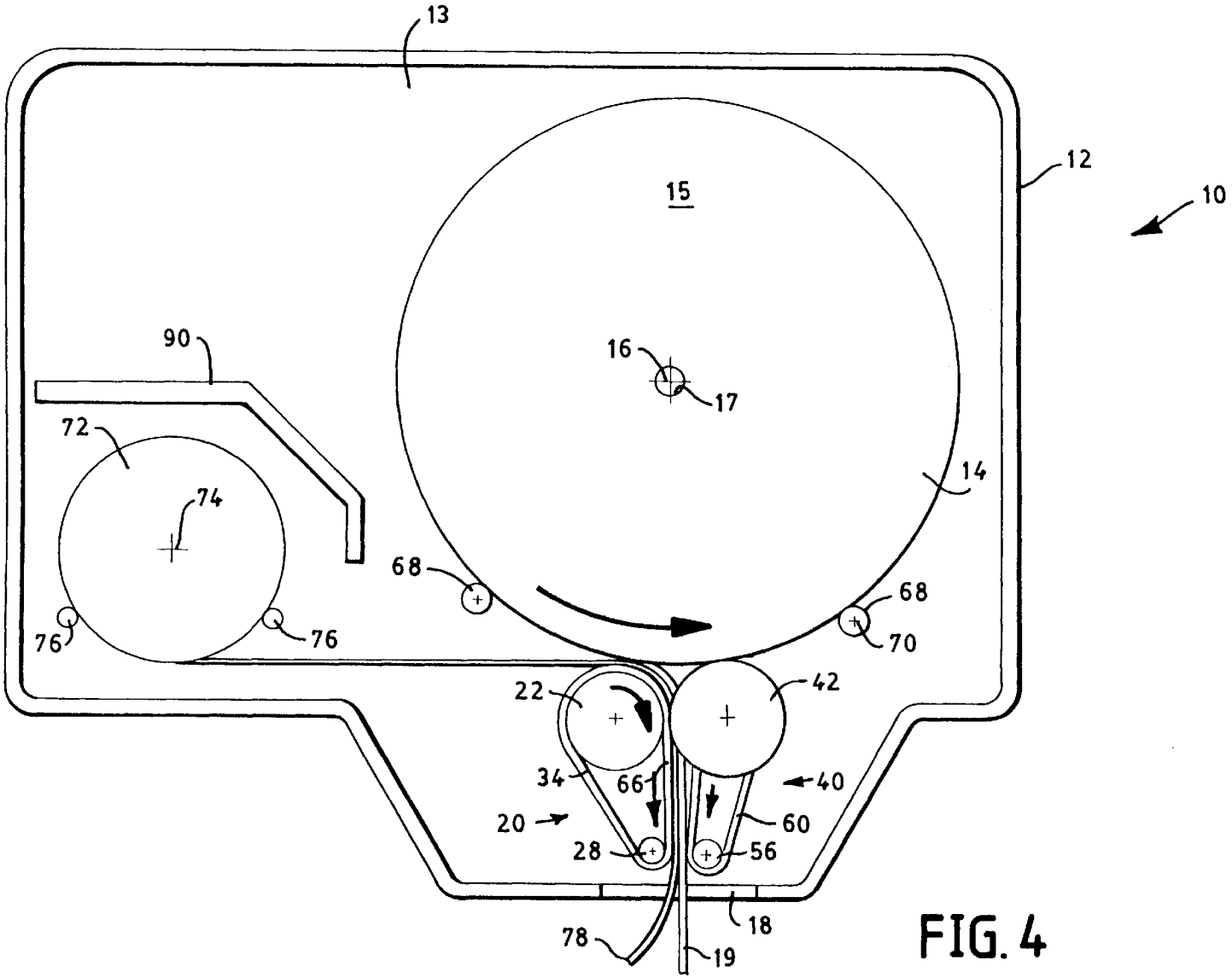
FIG. 4 is a front view of another embodiment of the dispenser according to the present invention, the dispenser having a transparent front panel.
Figure 5:
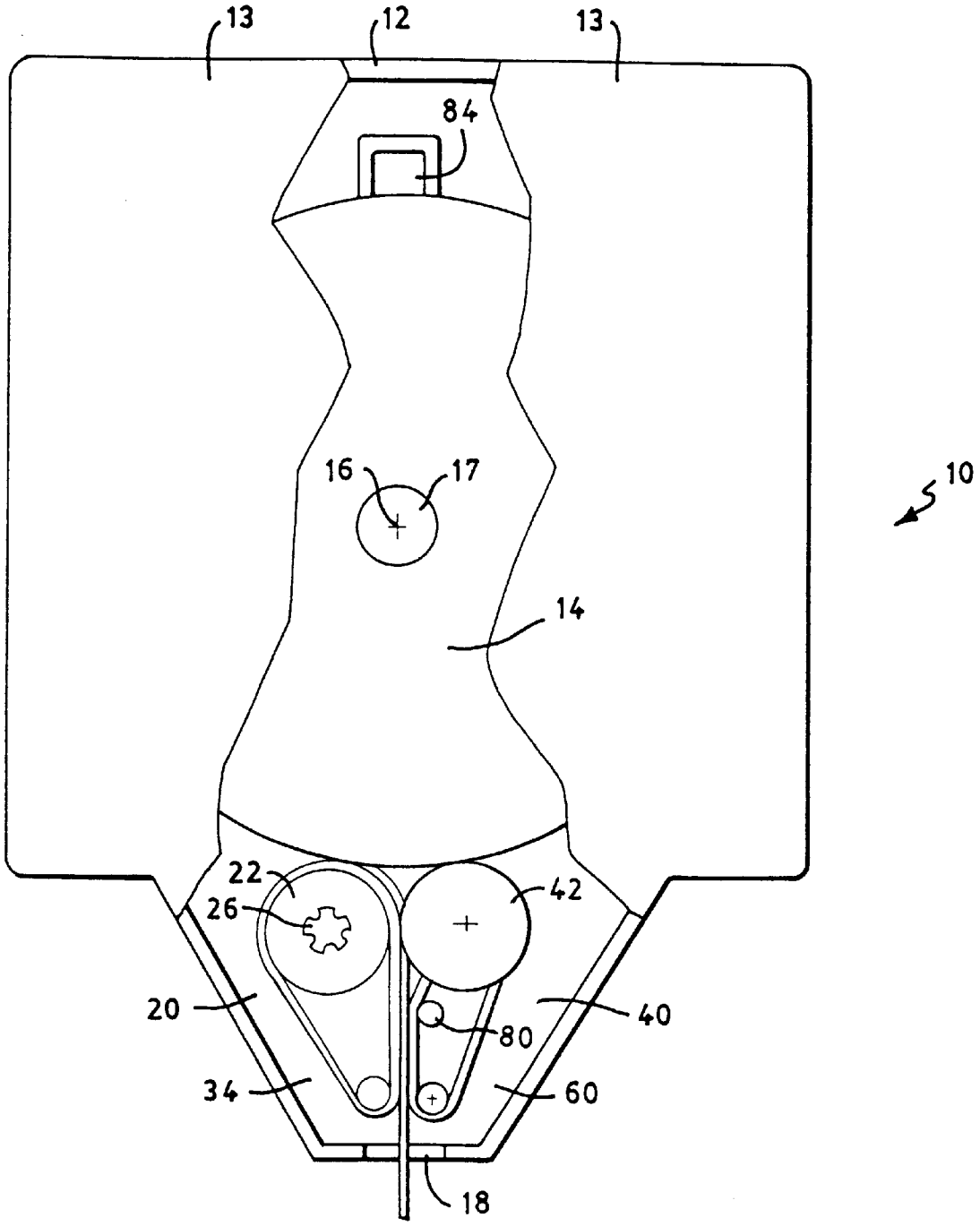
FIG. 5 is a front view of yet another embodiment of the dispenser according to the present invention, the dispenser having an opaque front panel shown partially cut away.

In response to the foregoing challenges which have been experienced by those of skill in the art, the present invention is directed toward a dispenser for dispensing a jumbo roll of material. An embodiment of the dispenser is depicted in FIG. 1 at 10. The dispenser 10 includes a housing 12 which is adapted to receive a jumbo roll 14 of material such as, for example, bath tissue, towels, wipers or the like. The housing 12 may be variously configured. In some embodiments, the housing 12 may include a front panel 13 and a back portion, the back portion being mountable to a horizontal surface such as a wall. The front panel 13, as shown in FIGS. 1 and 4, is transparent and may be releasably attached to the housing 12. All or a portion of the front panel 13 may be formed of an opaque material. For example, as shown in FIG. 5, the front panel 13, shown in cutaway, is opaque. The jumbo roll 14 may be mounted within the housing 12 by removing the front panel 13, placing the roll 14 within the housing 12 and attaching the front panel 13 to the housing 12.

The jumbo roll 14 may be a coreless roll or a cored roll of material having a rotational axis 16. The jumbo roll 14, shown in FIG. 1, is a coreless roll of material formed of a rolled web of material that is wound entirely throughout its diameter about the rotational axis 16 into a cylinder having two flat ends spaced apart from each other. In selected coreless rolls, at least one flat end 15 may include a mounting hole 17, shown in FIG. 4, along the rotational axis 16 of the coreless jumbo roll 14. The mounting hole 17 has a depth, and sides which are generally perpendicular to the end of the roll, the sides of the mounting hole 17 being separated by a distance that is less than the depth of the mounting hole 17. The mounting hole 17 of the coreless roll may be adapted to receive a plunger from a typical rotary dispenser, the plunger preventing radial displacement of the coreless roll 14 with respect to the housing 12 during use. In some embodiments, the coreless roll 14 may be wound substantially throughout its diameter to define a mounting hole 17 that includes a central aperture that extends entirely through the roll 14 along the length of the axis 16.

The housing 12 further includes an opening 18 through which the material may be dispensed. In some embodiments, the opening 18 may include a serrated or sharp edge which may assist the user in tearing a desired amount of material from the roll.

In certain embodiments, the roll 14 may be mounted within the housing 12 so that the rotational axis 16 of the jumbo roll 14 is perpendicular to the wall or surface on which the housing 12 is mounted. Other orientations of the housing 12 and the roll 14 may also be used with the present invention.

Figure 2:
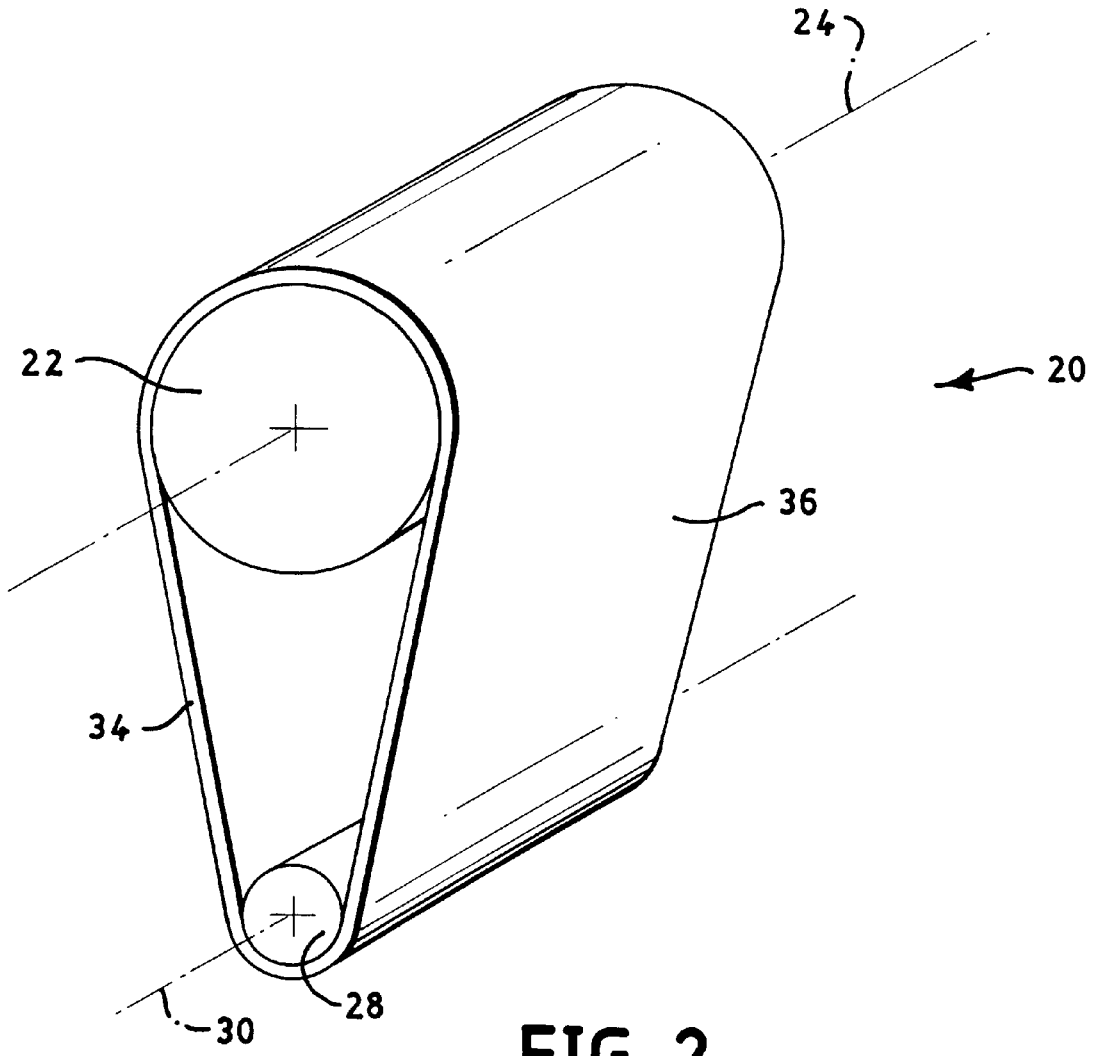
FIG. 2 is a perspective view of an embodiment of the first drive assembly.

A first drive assembly 20, best seen in FIGS. 1 and 2, is mounted within the housing 12 and, in selected embodiments, includes a first drive roller 22. The first drive roller 22 may be rotatably mounted to the housing 12 along its rotational axis 24. The first drive roller 22 may be positioned with respect to the roll of material 14 so that the rotational axis 24 of the first drive roller 22 is parallel to the rotational axis 16 of the roll of material 14.

In the embodiments depicted in FIGS. 1 and 2, a first feed roller 28 is rotatably mounted to the housing 12. The first feed roller 28 rotates about its rotational axis 30 which, as shown in the embodiments of FIGS. 1 and 2, is parallel to the axis of rotation 24 of the first drive roller 22. A first belt 34 is also included in the first drive assembly 20. The first belt 34 contacts the first drive roller 22 and the first feed roller 28 so that, as the first drive roller 22 and the first feed roller 28 rotate about their rotational axes 24 and 30, respectively, the first belt 34 rotates in the same direction. Thus, if the first drive roller 22 and the first feed roller 28 are rotating in a clockwise direction, the first belt 34 also rotates in a clockwise direction. Likewise, if the first drive roller 22 and the first feed roller 28 are rotating in a counter-clockwise direction, the first belt 34 also rotates in a counterclockwise direction.

Figure 3:
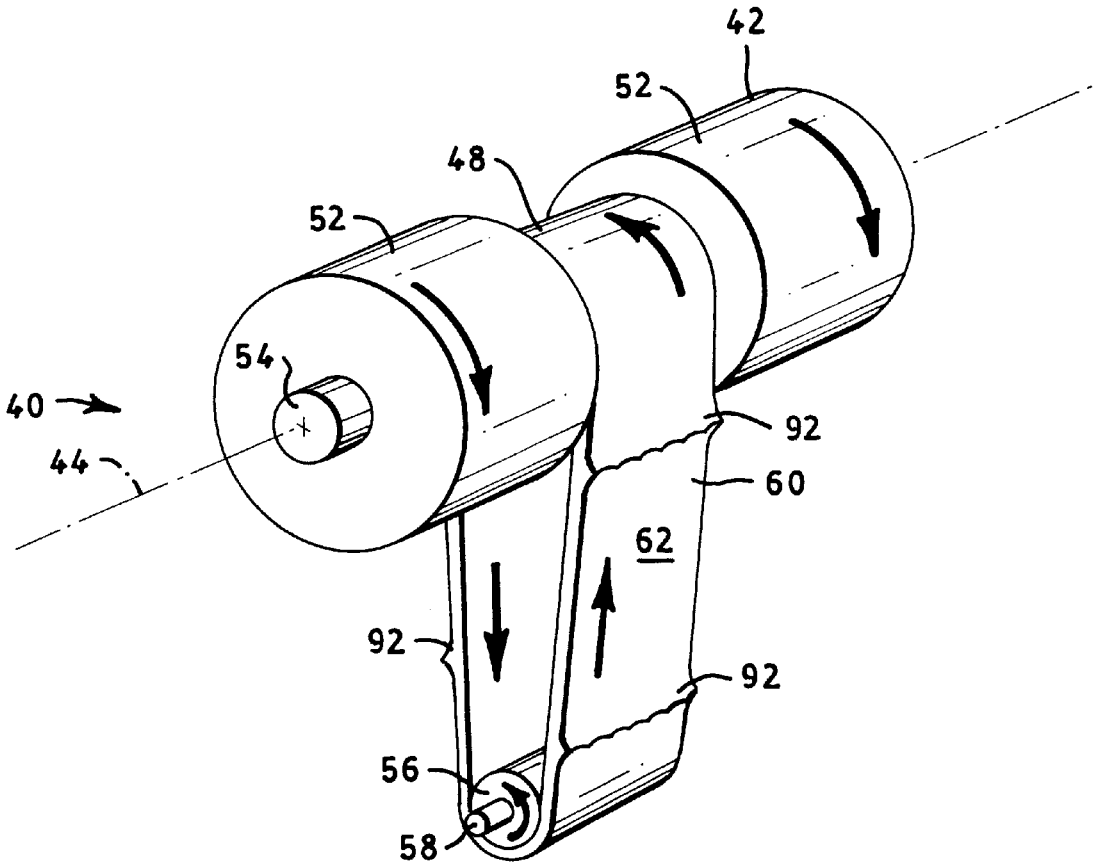
FIG. 3 is a perspective view of an embodiment of the second drive assembly.

The dispenser 10 may also include a second drive assembly 40, best shown in FIGS. 1 and 3. The second drive assembly 40 may be mounted within the housing 12. The second drive assembly 40 may include a second drive roller 42 which may be rotatably mounted to the housing 12. The axis of rotation 44 of the second drive roller 42 is parallel to the axis of rotation of the jumbo roll of material 14 in selected embodiments.

The second drive roller 42 may, in certain embodiments, include a belt portion 48 and at least one roller support portion 52. The embodiment depicted in FIG. 3 includes two roller support portions 52, the belt portion 48 being disposed therebetween. Each portion of the second drive roller 42 may be rotatable about the axis of rotation 44, and each portion 48 and 52 may rotate about the rotational axis 44 independently of the other portions. For example, the belt portion 48 of the second drive roller 42 may be rotating in a counterclockwise direction while the support portions 52 of the second drive roller 42 may be rotating in a clockwise direction. A variety of configurations of the second drive roller 42 may be utilized within the present invention. For example, the support portions 52 and the belt portion 48 may be rotatably mounted to a rod 54 so that each portion is independently rotatable about the rod 54. In alternate embodiments, the support portions 52 and the rod 54 may be formed as a unitary piece, the belt portion 48 being rotatably mounted to the rod 54 between the support portions 52.

A second feed roller 56 may be included in the second drive assembly 40. The second feed roller 56 has, in particular embodiments, an axis of rotation 58 which is parallel to the axis of rotation 44 of the second drive roller 42. The second feed roller 56 is, in some embodiments, rotatably mounted to the housing 12. A second belt 60 may contact the second feed roller 56 and the belt portion 48 of the second drive roller 42 so that, as the belt portion 48 and the second feed roller 56 rotate about their respective axes of rotation, the second belt 60 also rotates in the same direction.

A portion of the roll of material 14 may contact the first drive roller 22 or may contact the first belt 34. In some embodiments, the roll of material 14 may contact both the first drive roller 22 and the first belt 34. The roll of material 14 may contact the support portions 52 of the second drive roller 42 of the second drive assembly 40.

Some embodiments of the present invention may include a mechanism which urges the drive roll away from the feed roll to maintain the appropriate tension in the belt. Such mechanisms are commonly known and may include, for example, a spring, compressed cylinder, or the like.

In the embodiments depicted in FIGS. 1–3, the roll of material 14 is supported within the housing 12 by the first and second drive assemblies 20 and 40, respectively. Additional support rollers 68 may also be provided to support the roll of material 14. The support rollers 68 may, in selected embodiments, be rotatably mounted to the housing 12 so that they are free to rotate as the roll of material 14 rotates.

In some embodiments, the first drive assembly 20 and the second drive assembly 40 are positioned with respect to each other so that a surface 36 of the first belt is proximate to a surface 62 of the second belt 60. These surfaces form a channel 66 between the first drive assembly 20 and the second drive assembly 40 through which the end 19 of the roll of material 14 extends.

Upon placement of the roll 14 in the housing 12, the end 19 of the roll of material 14 may be fed downwardly through the channel 66 formed by the surface 36 of the first belt 34 and the surface 62 of the second belt 60. To facilitate feeding of the end 19 through the channel 66, an additional feed assist mechanism may be provided which enables a user to cause one or both of the drive assemblies 20 and 40 to rotate, thereby causing the roll 14 to dispense additional material through the channel 66. This permits a user to cause the end 19 to move downwardly through the channel 66 so that the end 19 may be grasped by a user. Such mechanisms may include, for example, a crank handle attached to the rotational axis of the first drive roller so that, as a user pulls downwardly on the crank handle, the drive roller rotates about its rotational axis. The crank handle is adapted to return to its original position so that it may be activated again when needed.

Alternate embodiments may include a knob 26 mechanically connected to the first drive roller so that, as the knob is turned by a user, the first drive roller 22 is rotated. Such a knob is depicted in FIG. 5, the knob 26 extending through the front panel 13 of the housing 12. In other embodiments, a disk or other type of hand wheel may be positioned exteriorly of the housing 12, the disk being connected to the first drive roller so that, as a user causes the disk to rotate, the first drive roller 22 is also rotated which urges the end 19 downwardly toward the opening 18 of the dispenser 10. A variety of other feed assist mechanisms may be utilized in the present invention, including, for example, electromechanical feed assist mechanisms.

In some embodiments, the belts 34 and 60 may be positioned so that, at selected points or along certain portions of the channel 66, the belts 34 and 60 contact each other to form a nip. In such embodiments, the belts 34 and 60 may contact the material being fed through the channel 60. As the material being dispensed from the roll 14 is in contact with a portion of the belts 34 and 60, the material may be less likely to be drawn upward through the channel 66 and into the housing 12 where a user would not be able to easily access the end 19.

A roll of material 14, when positioned within the housing 12, will rotate in a particular direction during a dispensing event. The direction of rotation of the roll of material 14 during a dispensing event will be determined by the direction of the free end 19. For example, the roll 14 may be placed within the housing so that the free end 19 is directed to the right when the free end is positioned at the bottom of the roll 14. When oriented in the housing thusly, the roll 14 rotates counterclockwise about its rotational axis 16 when the end 19 is pulled. Alternately, the roll 14 may be placed within the housing 12 so that the free end 19 is directed to the left when the free end is positioned at the bottom of the roll 14. When oriented in the housing thusly, the roll 14 rotates clockwise about its rotational axis as the end 19 is pulled. Although the roll may be mounted within the housing so that it rotates, during a dispensing event, in either the clockwise or counterclockwise direction, for descriptive purposes, the roll 14 will be assumed to be mounted within the housing so that the roll 14 unwinds in the counterclockwise direction.

In a dispensing event and as shown by the arrows in FIGS. 1–3, the end 19 is pulled downwardly by a user, urging the belts 34 and 60 to rotate. The rotation of the belts 34 and 60 urges the drive and feed rolls to rotate, which in turn urge the roll 14 to rotate counterclockwise. As shown therein, the first drive roller 22 and the first feed roller 38 rotate in a clockwise direction, the first belt 34 also moving in clockwise direction. The rotation of the first drive assembly 20 may thus assist the user in dispensing material from the roll 14.

The movement of the second drive assembly 40 may also assist in dispensing material from the roll 14. As the roll 14 is rotated counterclockwise by the first drive assembly 20, the support portions 52 of the second drive roller 42 rotate in a clockwise direction, as shown by the arrows in FIG. 1 and FIG. 3. The belt portion 48 of the second drive roller 42 rotates in a counterclockwise direction, the second belt 60 also moving in a counterclockwise direction. In such an embodiment, the surfaces 36 and 62 of the belts 34 and 60, respectively, are continuously moving downwardly through the channel 60. Thus, the material of the roll 14 positioned within the channel 60 assist in keeping material moving downwardly and out of the housing 12 through the opening 18. A user may then utilize a sharp or serrated edge of the opening 18 to tear the desired amount of material from the roll 14.

A wide variety of belts may be utilized in the present invention. In selected embodiments, urethane belts may be utilized. The housing and the drive, feed, support and auxiliary rolls utilized in the present invention may be formed from a variety of materials including, for example, metals, plastics, ceramics or any combination thereof. The first and second drive assemblies may additionally provide a braking function. The roll 14 will turn at the same rotational speed as the first and second drive rollers, which turn at the same rotational speed as the belt. A coating may be applied to the belts and/or rollers which contact the roll of material 14 to alter the braking function of the drive assemblies. For example, a friction-reducing coating may be utilized on the belts and/or rollers to reduce the braking function of the drive assemblies.

Selected embodiments of the dispenser 10 may additionally accommodate a roll of material which has been partially dispensed. Such rolls have a smaller diameter than unused rolls and may be referred to as "stub" rolls.

As shown in the embodiment depicted in FIG. 4, a stub roll 72 having a rotational axis 74 is supported on two stub support rollers 76. The stub support rollers 76 may be rotatably mounted to the housing 12. The end 78 of the stub roll 72 may be passed between the roll 14 and the first belt 34 and/or the first drive roller 22, so that the material of the stub roll 72 is disposed between the first drive assembly 20 and the material of the roll 14. The end 78 may then be passed through the channel 66 formed by the surfaces 36 and 62 of the belts 34 and 60, respectively. In this manner, material from both the stub roll 72 and the roll 14 may be dispensed at the same time. To reduce the likelihood that the stub roll 72 would interfere with the rotation of the roll 14, a divider 90 may be provided which extends outwardly from the back portion of the housing 12. The divider 90 may be segmented or continuous.

In certain embodiments and as shown in FIG. 5, an auxiliary roller 80 may be provided to urge the surface 36 of the first belt 34 toward the surface 62 of the first belt 34. The auxiliary roller may be adapted to rotate about its axis, and may, in some embodiments, be rotatably attached to the housing 12.

The belts 34 and 60 may further include the raised portions 92, shown in FIG. 3, which may form perforations, detents or the like in the material to assist a user in tearing a desired amount of material from the roll 14. Such raised portions may also be included on other elements of the dispenser 10 such as, for example, the support portions 52 of the second drive roller 42 or the first drive roller 22.

Selected embodiments of the housing 12 may further include a guide track 84, depicted in FIG. 5. In such embodiments, a rod may be passed through the core of a cored roll 14, an end of the rod being placed within the guide track 84.

While the invention has been described in detail with respect to specific preferred embodiments thereof, it will be appreciated that those skilled in the art, upon attaining an understanding of the foregoing, may readily conceive of alterations to and variations of the preferred embodiments. Such alterations and variations are believed to fall within the scope and spirit of the invention and the appended claims.

We claim:

1. A dispenser for dispensing a jumbo roll of material having an axis of rotation, the dispenser comprising:

a housing adapted to receive a jumbo roll of material;

a first drive assembly including a first belt; and a second drive assembly including a second belt, the first drive assembly and second drive assembly being positioned with respect to each other so that a surface of the first belt is proximate to a surface of the second belt thereby forming a channel through which the material must pass, the channel assisting in retaining the material in a dispensing position;

the first and second drive assemblies being positioned within the housing so that the jumbo roll of material is supportable by the first drive assembly and the second drive assembly, a free end of the jumbo roll of material being positionable between the surfaces of the first belt and the second belt so that, as the first belt and second belt rotate, the material is dispensed from the jumbo roll.

2. The dispenser of claim 1, the first drive assembly including a first drive roller having an axis of rotation which is parallel to the axis of rotation of the jumbo roll of material, the first drive roller being rotatably mounted to the housing.

3. The dispenser of claim 2, the first drive assembly further including a first feed roller having an axis of rotation which is parallel to the axis of rotation of the first drive roller, the first feed roller being rotatably mounted to the housing.

4. The dispenser of claim 3, the first belt contacting the first drive roller and the first feed roller so that, as the first drive roller and the first feed roller rotate about their respective axes of rotation, the first belt rotates in the same direction.

5. The dispenser of claim 4 further including a biasing mechanism which urges the first drive roll away from the first feed roll to maintain appropriate tension in the first belt.

6. The dispenser of claim 1, the second drive assembly including a second drive roller having an axis of rotation which is parallel to the axis of rotation of the jumbo roll of material, the second drive roller being rotatably mounted to the housing and comprising a belt portion and a roller support portion, each portion being rotatable about the axis of rotation of the second drive roller independently of the other portion.

7. The dispenser of claim 6, the second drive assembly further including a second feed roller having an axis of rotation which is parallel to the axis of rotation of the second drive roller, the second feed roller being rotatably mounted to the housing.

8. The dispenser of claim 7, the second belt contacting the belt portion of the second drive roller and the second feed roller so that, as the belt portion of the second drive roller and the second feed roller rotate about their respective axes of rotation, the second belt rotates in the same direction.

9. The dispenser of claim 8 further including a biasing mechanism which urges the second drive roll away from the second feed roll to maintain appropriate tension in the second belt.

10. The dispenser of claim 1 further including a feed assist mechanism adapted to rotate the roll of material.

11. The dispenser of claim 10 wherein the feed assist mechanism includes a knob.

12. The dispenser of claim 1 including a front panel.

13. The dispenser of claim 12, the front panel being at least partially transparent.

14. The dispenser of claim 1, the belt including raised portions adapted to create indentations in the material being dispensed.

15. A dispenser for dispensing a jumbo roll of material having an axis of rotation, the dispenser comprising:

a housing adapted to receive a jumbo roll of material;

a first drive assembly comprising a first drive roller having an axis of rotation which is parallel to the axis of rotation of the jumbo roll of material, the first drive roller being rotatably mounted to the housing, a first feed roller having an axis of rotation which is parallel to the axis of rotation of the first drive roller, the first feed roller being rotatably mounted to the housing, and a first belt which contacts the first drive roller and the first feed roller so that, as the first drive roller and the first feed roller rotate about their respective axes of rotation, the first belt rotates in the same direction;

a second drive assembly comprising a second drive roller having an axis of rotation which is parallel to the axis of rotation of the jumbo roll of material, the second drive roller being rotatably mounted to the housing and comprising a belt portion and a roller support portion, each portion being rotatable about the axis of rotation of the second drive roller independently of the other portion, a second feed roller having an axis of rotation which is parallel to the axis of rotation of the second drive roller, the second feed roller being rotatably mounted to the housing, and a second belt which contacts the belt portion of the second drive roller and the second feed roller so that, as the belt portion of the second drive roller and the second feed roller rotate about their respective axes of rotation, the second belt rotates in the same direction, the first drive assembly and second drive assembly positioned with respect to each other so that a surface of the first belt is proximate to a surface of the second belt thereby forming a channel through which the material must pass, the channel assisting in retaining the material in a proper position;

the first and second drive assemblies being positioned within the housing so that the jumbo roll of material is supportable by the first drive roller and the support portion of the second drive roller, the free end of the jumbo roll of material being positionable between the surfaces of the first belt and the second belt so that, as the first belt and second belt rotate, the material is dispensed from the jumbo roll.

16. A dispenser comprising:

a housing adapted to receive a roll of material;

a first drive roller rotatably mounted within the housing, a first feed roller rotatably mounted within the housing, and a first belt which contacts the first drive roller and the first feed roller;

a second drive roller rotatably mounted within the housing, the second drive roller comprising a belt portion and a roller support portion, each portion being independently rotatable, a second feed roller rotatably mounted within the housing, and a second belt which contacts the belt portion of the second drive roller and the second feed roller, the first belt and the second belt positioned with respect to each other so that a surface of the first belt is proximate to a surface of the second belt;

the first drive roller and the second drive roller being positioned within the housing so that the roll of material is supportable by the first drive roller and the support portion of the second drive roller.

17. The dispenser of claim 16 further including a feed assist mechanism adapted to rotate the roll of material.

18. The dispenser of claim 17 wherein the feed assist mechanism includes a knob.

19. The dispenser of claim 16 including a front panel.

20. The dispenser of claim 19, the front panel being at least partially transparent.

21. The dispenser of claim 16, the belt including raised portions adapted to create indentations in the material being dispensed.

* * * * *